US008121522B2

(12) United States Patent
Yamada

(10) Patent No.: US 8,121,522 B2
(45) Date of Patent: Feb. 21, 2012

(54) TRANSFER APPARATUS AND IMAGE FORMING APPARATUS INCLUDING THE SAME

(75) Inventor: Katsuhiro Yamada, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 459 days.

(21) Appl. No.: 12/365,616

(22) Filed: Feb. 4, 2009

(65) Prior Publication Data

US 2009/0196651 A1 Aug. 6, 2009

Related U.S. Application Data

(60) Provisional application No. 61/026,677, filed on Feb. 6, 2008.

(51) Int. Cl.
*G03G 21/00* (2006.01)

(52) U.S. Cl. ..... 399/124; 399/121

(58) Field of Classification Search ..... 399/121, 399/124, 125, 297, 302, 308
See application file for complete search history.

(56) References Cited

U.S. PATENT DOCUMENTS

| | | | | |
|---|---|---|---|---|
| 6,973,279 | B2 * | 12/2005 | Yokoi | 399/124 |
| 6,993,268 | B2 * | 1/2006 | Otaka | 399/124 |
| 7,391,993 | B2 * | 6/2008 | Ito | 399/124 |
| 7,460,814 | B2 * | 12/2008 | Ito | 399/124 |

FOREIGN PATENT DOCUMENTS

| | | |
|---|---|---|
| JP | P2004-020574 | 1/2004 |
| JP | P2006-282381 | 10/2006 |

* cited by examiner

*Primary Examiner* — Sandra Brase
(74) *Attorney, Agent, or Firm* — Patterson & Sheridan, LLP

(57) ABSTRACT

A transfer apparatus of the invention includes a primary transfer unit, and a secondary transfer unit that includes a transfer roller having a bearing and being capable of contacting with and separating from the primary transfer unit, the primary transfer unit includes a guide member receiving the bearing at a position opposite to the bearing, and the guide member has a protrusion on a surface with which the bearing contacts when the transfer roller contacts with and separates from the primary transfer unit.

18 Claims, 10 Drawing Sheets

FRONT SIDE BEARING AMD GUIDE MEMBER

REAR SIDE BEARING AND GUIDE MEMBER

RELATED ART

FRONT SIDE BEARING AMD GUIDE MEMBER

REAR SIDE BEARING AND GUIDE MEMBER

REAR SIDE BEARING AND GUIDE MEMBER

FRONT SIDE BEARING AMD GUIDE MEMBER

TRANSFER APPARATUS AND IMAGE FORMING APPARATUS INCLUDING THE SAME

CROSS-REFERENCE TO RELATED APPLICATIONS

This application is based upon and claims the benefit of priority from U.S. provisional application 61/026,677, filed on Feb. 6, 2008, the entire contents of each of which are incorporated herein by reference.

TECHNICAL FIELD

The present invention relates to a transfer apparatus and an image forming apparatus including the same, and particularly to a transfer apparatus a part of which is constructed to be openable and closable relative to the main body of an image forming apparatus and the image forming apparatus including the same.

BACKGROUND

As an image forming apparatus of an electrophotographic system, such as a laser printer, a digital copying machine, or a laser facsimile, there is a type in which a toner image formed on a photoconductor is primarily transferred to a transfer belt, and the toner image primarily transferred on the transfer belt is further secondarily transferred to a recording sheet. In this type of image forming apparatus, a transfer apparatus includes a primary transfer unit having a transfer belt and a secondary transfer unit having a secondary transfer roller.

The primary transfer unit includes, for example, a drive roller, a secondary transfer opposite roller, and a primary transfer roller, and the transfer belt is stretched over the drive roller and the secondary transfer opposite roller and is rotated. The primary transfer roller is disposed at a position inside of the transfer belt and opposite to the photoconductor, and a specified potential is applied to the primary transfer roller so that the toner image on the photoconductor is primarily transferred to the outer periphery of the transfer belt.

The secondary transfer roller of the secondary transfer unit and the secondary transfer opposite roller of the primary transfer unit form a nip through the transfer belt. A recording sheet contained in a paper feeding section passes through a specified conveyance path and passes through the nip. When the recording sheet passes through the nip, a specified potential is applied to the secondary transfer roller, and the toner image primarily transferred on the outer periphery of the transfer belt is secondarily transferred to the recording sheet.

The secondarily transferred toner image is fixed by a fixing apparatus, and then is discharged to a discharge tray or the like included in the image forming apparatus.

When the recording sheet passes through the conveyance path or passes through the nip, paper jamming may occur due to some cause.

In order to enable a user to remove the jammed recording sheet, the secondary transfer unit is constructed to be openable and closable relative to the outside of the main body of the image forming apparatus. For example, the lower side of the secondary transfer unit is supported to be rotatable around a support shaft provided at the main body of the image forming apparatus, and a hook to be hooked on a fixing member provided at the main body of the image forming apparatus is provided on the upper side of the secondary transfer unit. In a standing state in which the secondary transfer unit is closed, the hook urged by a spring or the like is hooked on the fixing member, and the secondary transfer unit is fixed to the main body of the image forming apparatus. When the secondary transfer unit is opened, the user operates a handle lever or the like provided at the outside of the secondary transfer unit to release the hooking between the hook and the fixing member, and opens the secondary transfer unit to the outside of the apparatus while rotating it around the support shaft.

In addition to this, there is a type in which a magnet is provided on the upper side of the secondary transfer unit, and the secondary transfer unit is fixed to the main body of the image forming apparatus by the magnetic force of the magnet.

As stated above, in the transfer apparatus (or the image forming apparatus) of the related art, the dedicated opening and closing mechanisms (the foregoing hook, spring, handle lever, magnet, etc.) for opening and closing the secondary transfer unit are required, and these opening and closing mechanisms cause the increase of the number of parts of the whole apparatus and cause the increase of cost.

SUMMARY

The present invention is made in view of the above circumstances, and has an object to provide a transfer apparatus in which an opening and closing mechanism of a secondary transfer unit is greatly simplified, and a dedicated opening and closing mechanism part can be made substantially unnecessary, and an image forming apparatus including the same.

In order to achieve the object, according to an aspect of the invention, a transfer apparatus includes a primary transfer unit, and a secondary transfer unit that includes a transfer roller having a bearing and being capable of contacting with and separating from the primary transfer unit, the primary transfer unit includes a guide member receiving the bearing at a position opposite to the bearing, and the guide member has a protrusion on a surface with which the bearing contacts when the transfer roller contacts with and separates from the primary transfer unit.

Besides, according to another aspect of the invention, an image forming apparatus includes a photoconductor on which a toner image is formed, a primary transfer unit that includes a transfer belt and primarily transfers the toner image formed on the photoconductor to the transfer belt, and a secondary transfer unit that includes a transfer roller having a bearing and being capable of contacting with and separating from the primary transfer unit and secondarily transfers the toner image primarily transferred on the transfer belt to a recording sheet, the primary transfer unit includes a guide member receiving the bearing at a position opposite to the bearing, and the guide member has a protrusion on a surface with which the bearing contacts when the transfer roller contacts with and separates from the primary transfer unit.

DETAILED DESCRIPTION

A transfer apparatus and an image forming apparatus including the same according to an embodiment of the invention will be described with reference to the accompanying drawings.

(1) Image Forming Apparatus

Figure 1:
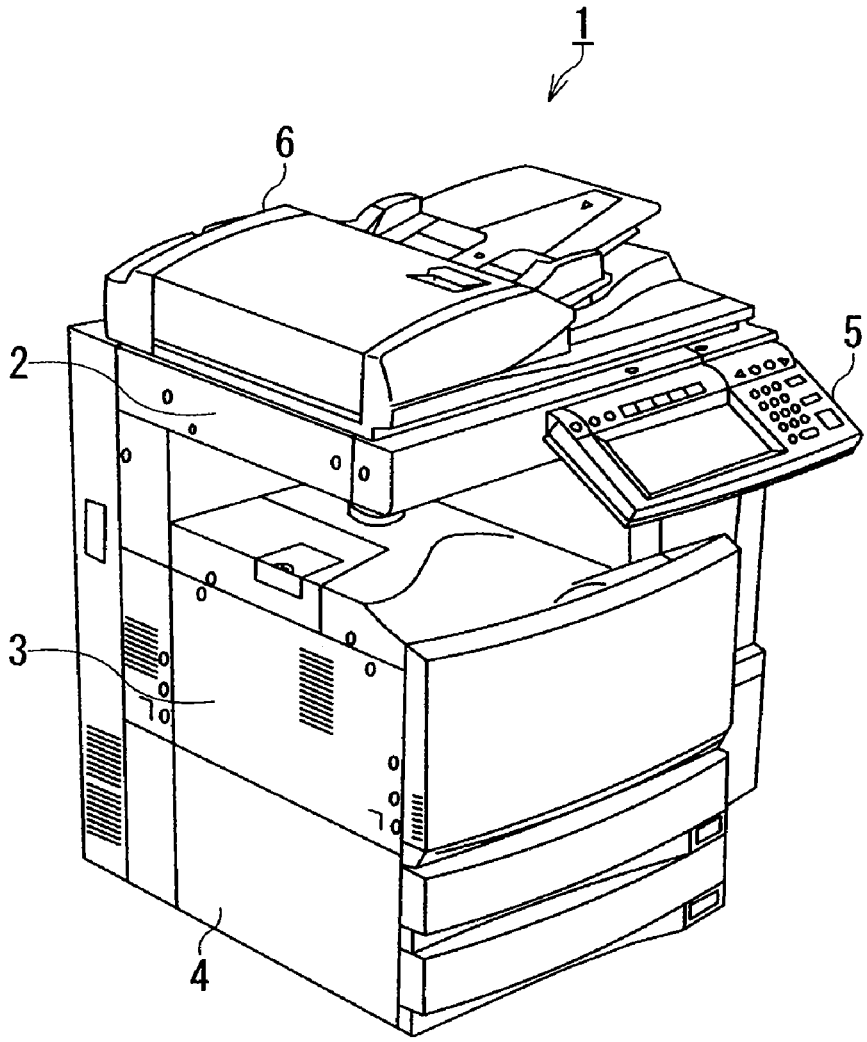
FIG. 1 is a perspective view showing an example of an outer appearance of an image forming apparatus of an embodiment.

FIG. 1 is a view showing an example of an outer appearance of a copying machine (or MFP) as a typical example of an image forming apparatus 1 of an embodiment.

The image forming apparatus 1 includes a reading section 2, an image forming section 3, a paper feeding section 4, an operation section 5, an ADF (Auto Document Feeder) 6 and the like.

The reading section 2 optically reads an original document placed on a document stand or an original document inputted to the ADF 6 and generates image data.

The image forming section 3 uses an electrophotographic system to print the image data on a sheet supplied from the paper feeding section 4.

The operation section 5 includes a display panel as a user interface and various operation buttons.

Figure 2:
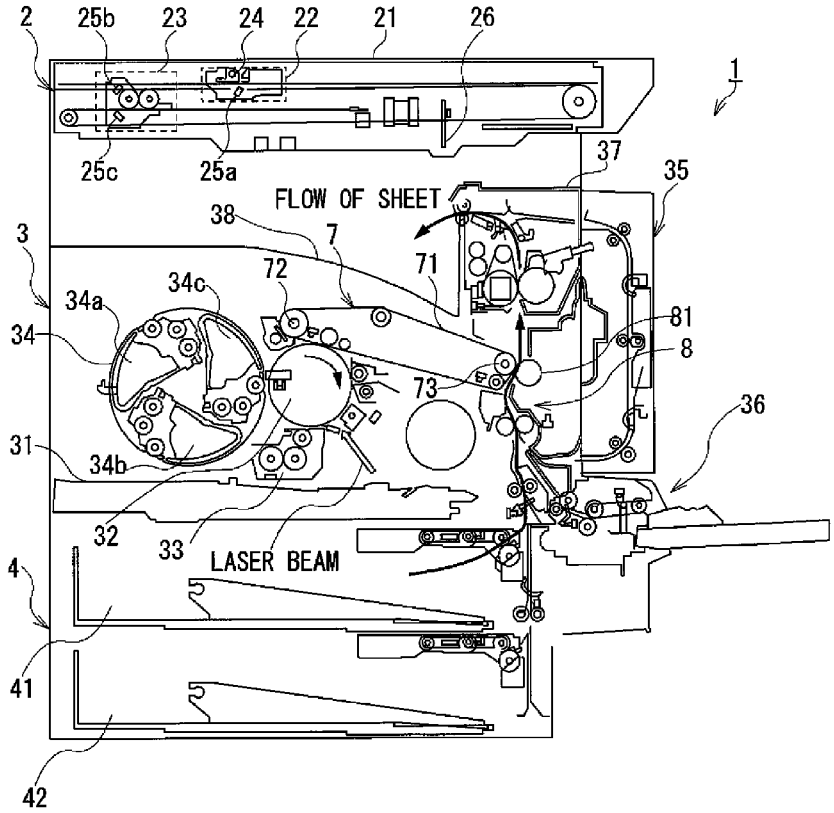
FIG. 2 is a sectional view showing an example of a detailed structure of the image forming apparatus of the embodiment.

FIG. 2 is a sectional view showing a more detailed structure of the image forming apparatus 1.

The reading section 2 includes a document glass stand 21, a first carriage 22, a second carriage 23, a CCD substrate 26 and the like.

The first carriage 22 and the second carriage 23 move in a right and left direction (main scanning direction) in FIG. 2. The first carriage 22 includes an exposure lamp 24, and the exposure lamp 24 irradiates an original document placed on the document glass stand 21 while moving in the main scanning direction. The reflected light from the original document is guided to the CCD substrate 26 through a mirror 25*a* of the first carriage 22 and mirrors 25*b* and 25*c* of the second carriage 23, and is converted into an electrical signal. The electrical signal is subjected to various image processings and image data is generated, and the image data is outputted to the image forming section 3.

The image forming section 3 includes a laser unit 31, a photoconductive drum 32, a black development unit 33, a revolver unit 34, a primary transfer unit 7, a secondary transfer unit 8, a fixing unit 37, a manual feed unit 36, an automatic duplex unit 35 and the like.

The laser unit 31 outputs a laser light modulated according to the level of the image data, and forms an electrostatic latent image on the photoconductive drum 32. The black development unit 33 develops the electrostatic latent image and forms a black toner image on the photoconductive drum 31.

Thereafter, the black toner image on the photoconductive drum 31 is primarily transferred to a transfer belt 71 of the primary transfer unit 7.

The transfer belt 71 is stretched over a drive roller 72 and a secondary transfer opposite roller 73, and the secondary transfer opposite roller 73 and a secondary transfer roller 81 of the secondary transfer unit 8 form a nip.

The paper feeding section 4 includes an upper paper feeding section 41 and a lower paper feeding section 42, and a sheet is picked up from either of the paper feeding sections and reaches the nip.

In the case of monochrome printing, the black toner image on the transfer belt 71 is secondarily transferred to the sheet at the nip. Thereafter, the toner image is fixed to the sheet by the fixing unit 37, and is discharged to a discharge tray 38.

On the other hand, in the case of color printing, toner images of respective colors developed by a cyan development unit 34*a*, a magenta development unit 34*b*, and a yellow development unit 34*c* included in the revolver unit 34 are superimposed and transferred onto the black toner image on the transfer belt 71. When the transfer belt 71 is rotated four times, the toner images of the four colors of black, cyan, magenta and yellow are superimposed and transferred onto the transfer belt 71, and a full-color toner image is formed. The full-color toner image is secondarily transferred to the sheet at the nip. Thereafter, the toner image is subjected to a fixing process and is discharged to the discharge tray 38.

In the manual feed unit 36, paper feeding is performed when manual feed printing is performed. Besides, the automatic duplex unit 35 realizes a paper feed path to automatically reverse the front and back of the sheet when duplex printing is performed.

The automatic duplex unit 35 is constructed to be openable and closable around a support shaft provided at the lower side of the unit in order to remove a jammed sheet and for maintenance.

(2) Transfer Apparatus

Figure 3:
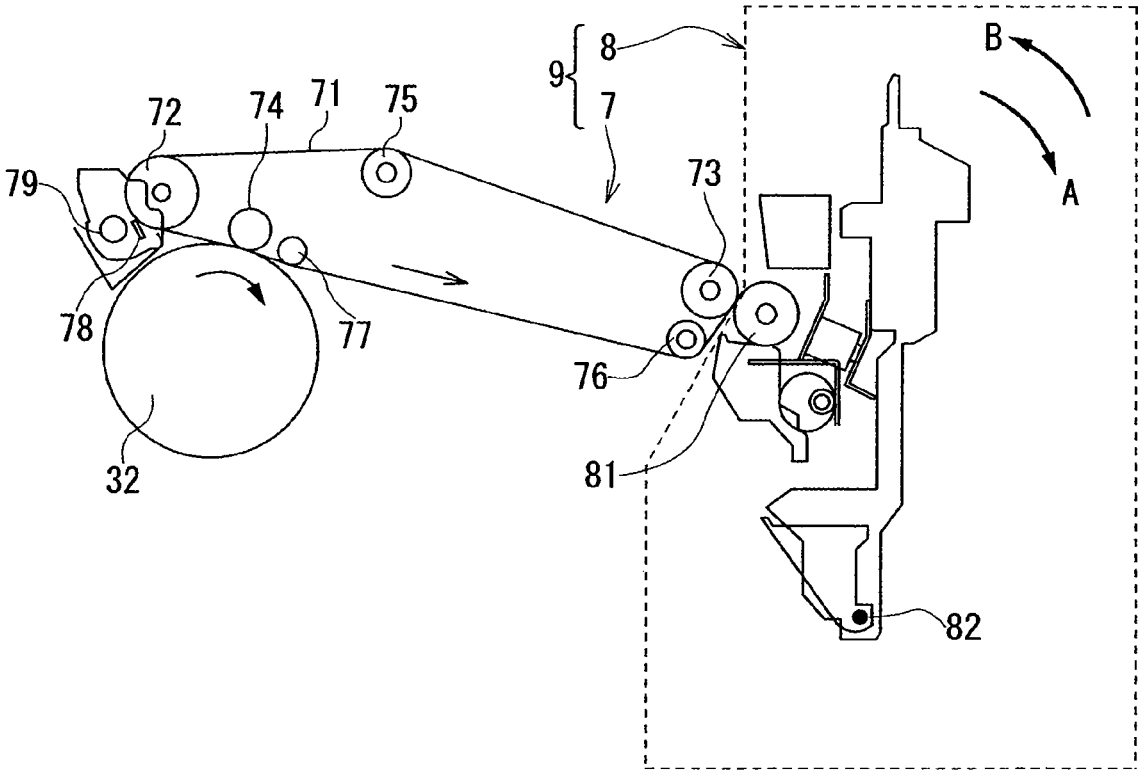
FIG. 3 is a sectional view showing an example of a structure of a transfer apparatus of the embodiment.

FIG. 3 is a sectional view showing an example of a structure of a transfer apparatus 9 included in the image forming apparatus 1. FIG. 3 also shows the photoconductive drum 32.

The transfer apparatus 9 includes the primary transfer unit 7 and the secondary transfer unit 8.

As described above, the primary transfer unit 7 is constructed such that the transfer belt 71 is stretched over the drive roller 72 and the secondary transfer opposite roller 73. The drive roller 72 is rotated by a not-shown drive motor, and the transfer belt 71 is continuously rotated in an arrow direction in FIG. 3.

A primary transfer roller 74 is provided at a position inside of the transfer belt 71 and opposite to the photoconductive drum 32. A specified voltage is applied to the primary transfer roller 74, so that the toner image on the photoconductive drum 32 is primarily transferred to the outer periphery of the transfer belt 71.

In addition to this, a tension roller 75, a secondary transfer guide roller 76, and an idle roller 77 are provided inside of the transfer belt 71. The tension roller 75 is urged upward in FIG. 3 by a not-shown spring or the like, and applies a specified tensile force to the transfer belt 71. The secondary transfer guide roller 76 keeps a position where the transfer belt 71 contacts with the secondary transfer roller 81. Similarly, the idle roller 77 keeps a position where the transfer belt 71 contacts with the photoconductive drum 32.

A cleaning blade 78 is provided to be adjacent to the drive roller 72, and removes toner remaining on the surface of the transfer belt 71. The waste toner scraped by the cleaning blade 78 is discharged to a not-shown toner bag by an auger 79.

The secondary transfer unit 8 includes the secondary transfer roller 81, and the secondary transfer roller 81 and the secondary transfer opposite roller 73 form a nip. When a sheet passes through the nip, a specified potential is applied to the secondary transfer roller 81, so that the toner image on the transfer belt 71 is secondarily transferred to the sheet.

The secondary transfer unit 8 is rotatable around a support shaft 82 provided at the lower side. When rotated in a direction of an arrow A of FIG. 3 (the secondary transfer unit 8 is opened), the secondary transfer roller 81 is separated from the primary transfer unit 7. With the secondary transfer unit 8 opened, the maintenance of the inside can be performed and a jammed sheet can be easily removed.

As shown in FIG. 2, the automatic duplex unit 35 is disposed at the outside of the secondary transfer unit 8. Accordingly, when the secondary transfer unit 8 is opened, the automatic duplex unit 35 is first opened, and then, the secondary transfer unit 8 is opened.

On the other hand, when the secondary transfer unit 8 is rotated in a direction of an arrow B of FIG. 3 (when the secondary transfer unit 8 is closed), the secondary transfer roller 81 and the primary transfer unit 7 contact with each other, and the secondary transfer roller 81 and the secondary transfer opposite roller 73 form a nip.

When the secondary transfer unit 8 is closed, it is necessary to perform alignment between the secondary transfer roller 81 and the secondary transfer opposite roller 73 with high accuracy. Thus, in a related art, guide members for guiding bearings at both ends of the secondary transfer roller 81 are provided in the vicinity of the secondary transfer opposite roller 73 of the primary transfer unit 7.

Figure 4:
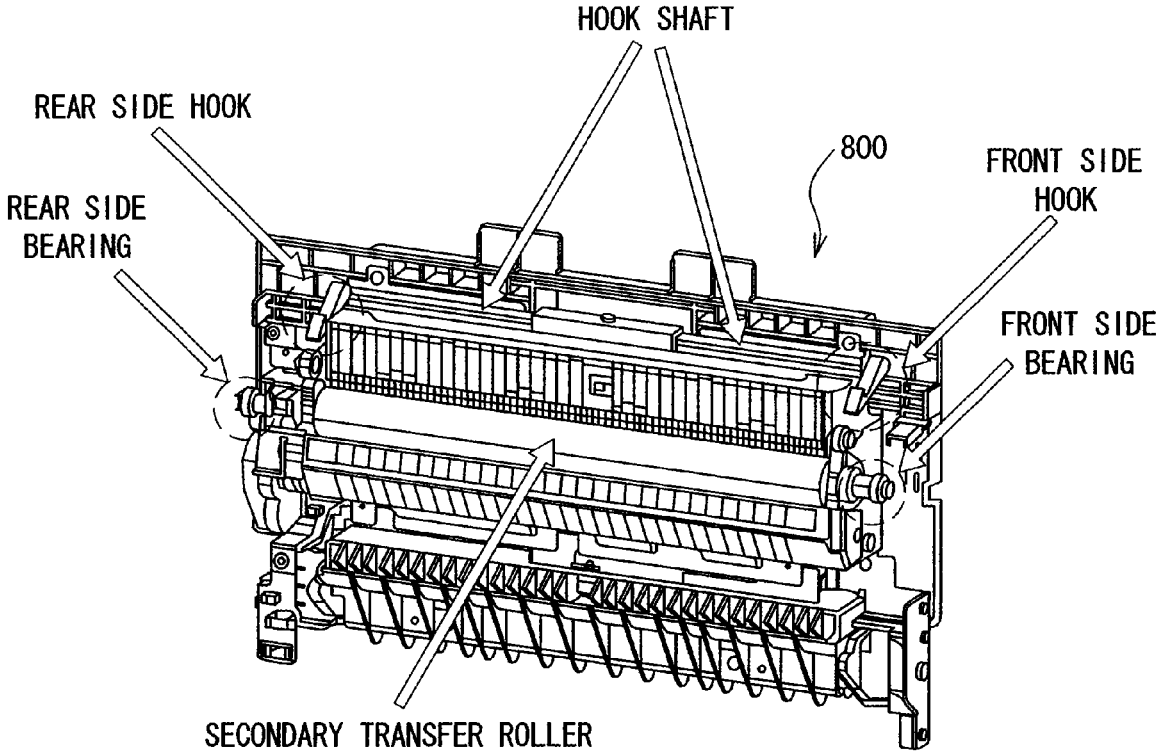
RELATED ART FIG. 4
FIG. 4 is a perspective view showing an example of an outer appearance of a related art secondary transfer unit.
Figure 5:
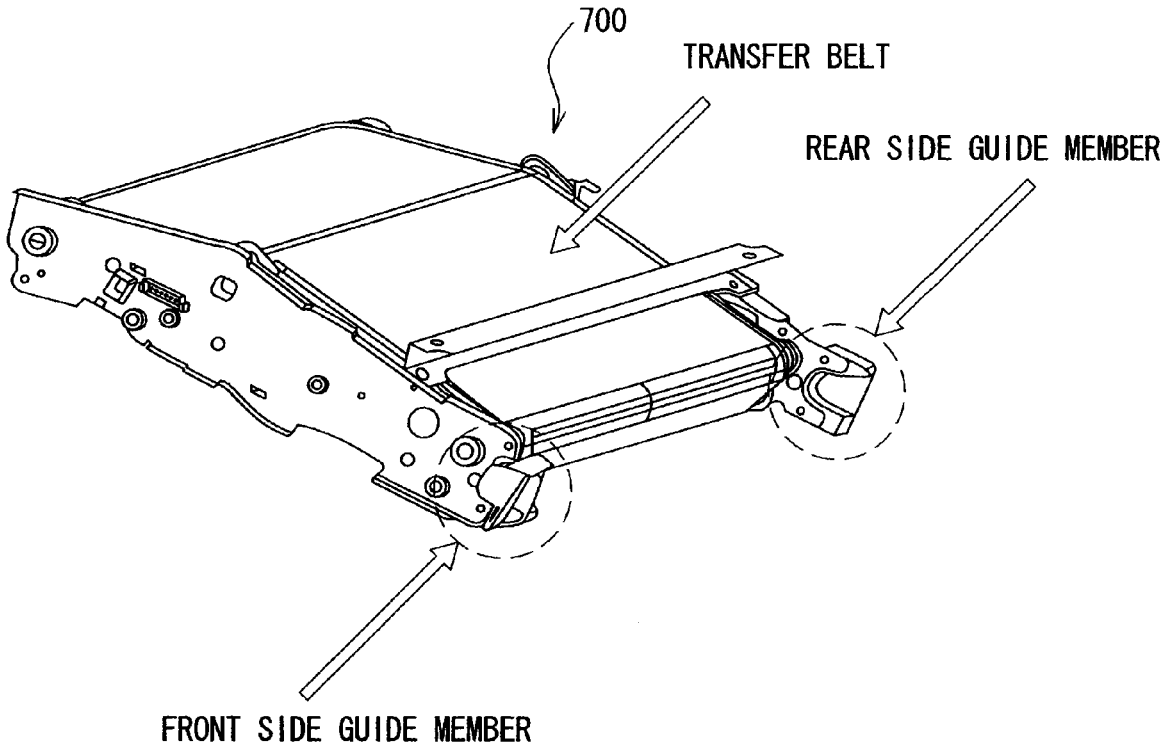
RELATED ART FIG. 5
FIG. 5 is a perspective view showing an example of an outer appearance of a related art primary transfer unit.

FIG. 4 is a perspective view showing an example of an outer appearance of a related art secondary transfer unit 800. FIG. 5 is a perspective view showing an example of an outer appearance of a related art primary transfer unit 700.

As shown in FIG. 4, the secondary transfer roller 81 is disposed almost at the center of the secondary transfer unit 800, and a front side bearing and a rear side bearing are respectively provided at both ends of the secondary transfer unit 800.

As shown in FIG. 5, at positions of the primary transfer unit 700 corresponding to the front side bearing and the rear side bearing, a front side guide member and a rear side guide member that align and receive these are respectively provided.

Figure 6A:
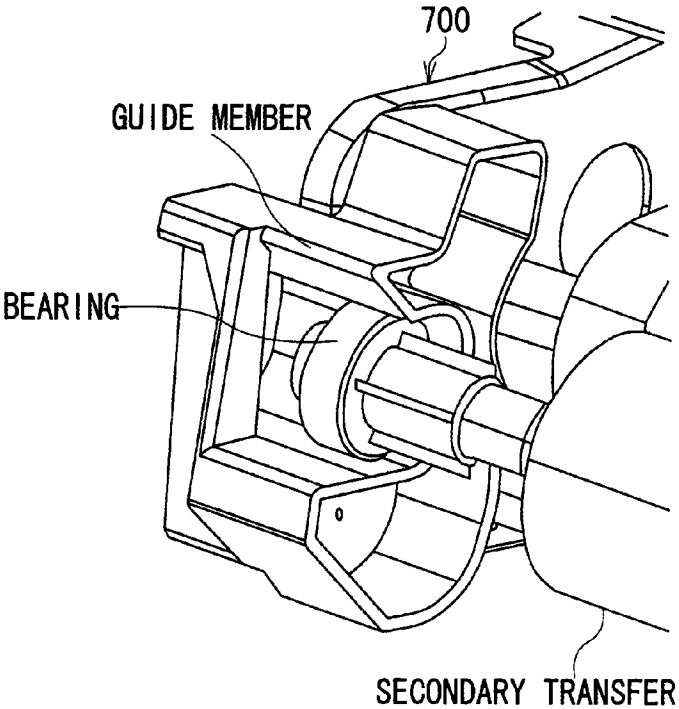
FIGS. 6A and 6B are enlarged perspective views each showing a state in which a bearing of a secondary transfer roller is received in a guide member of the related art primary transfer unit.
Figure 6B:
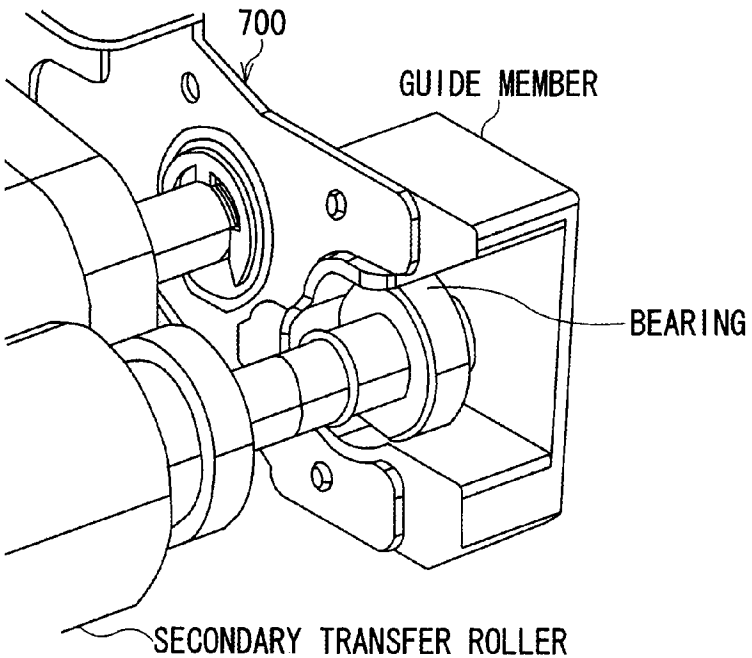

FIGS. 6A and 6B are enlarged views showing states in which the front side bearing and the rear side bearing are respectively received in the front side guide member and the rear side guide member of the related art.

As shown in FIG. 5, FIG. 6A and FIG. 6B, the bottom of each of the front side guide member and the rear side guide member of the related art is formed to be flat. Thus, although alignment can be performed when the secondary transfer unit 800 is closed, the closed secondary transfer unit 800 can not be fixed or held in a standing state.

Then, as shown in FIG. 4, the secondary transfer unit 800 of the related art is provided with, as dedicated opening and closing mechanisms, a front side hook, a rear side hook, a hook shaft and the like. In the standing state in which the secondary transfer unit 800 is closed, the respective hooks urged by springs or the like are hooked by fixing members provided on the housing of the image forming apparatus and are fixed and held. When the secondary transfer unit 800 is opened, the user operates a handle lever or the like provided on the outside of the secondary transfer unit 800 to rotate the hook shaft, releases the hooking between each hook and the fixing member, and opens the secondary transfer unit 800 to the outside of the apparatus while rotating it around the support shaft 82.

In addition to this, there is a type in which a magnet is provided on the upper side of the secondary transfer unit 800, and the secondary transfer unit is fixed to the main body of the image forming apparatus by the magnetic force of the magnet.

As stated above, in the related art transfer apparatus (or the image forming apparatus), the dedicated opening and closing mechanisms (the foregoing hook, spring, handle lever, magnet, etc.) for opening and closing the secondary transfer unit are required, and these opening and closing mechanisms cause the increase of the number of parts of the whole apparatus and cause the increase of cost.

In contrast, in the transfer apparatus 9 of the embodiment of the invention, protrusions 91*a* and 91*b* are provided on bottoms of a front side guide member 90*a* and a rear side guide member 90*b* of the primary transfer unit 7. That is, the protrusions 91*a* and 91*b*, for example, trapezoidal protrusions 91*a* and 91*b* are provided on surfaces with which a rear side bearing 81*a* and a front side bearing 81*b* contact when the secondary transfer roller 81 contacts with and separates from the primary transfer unit.

Figure 7B:
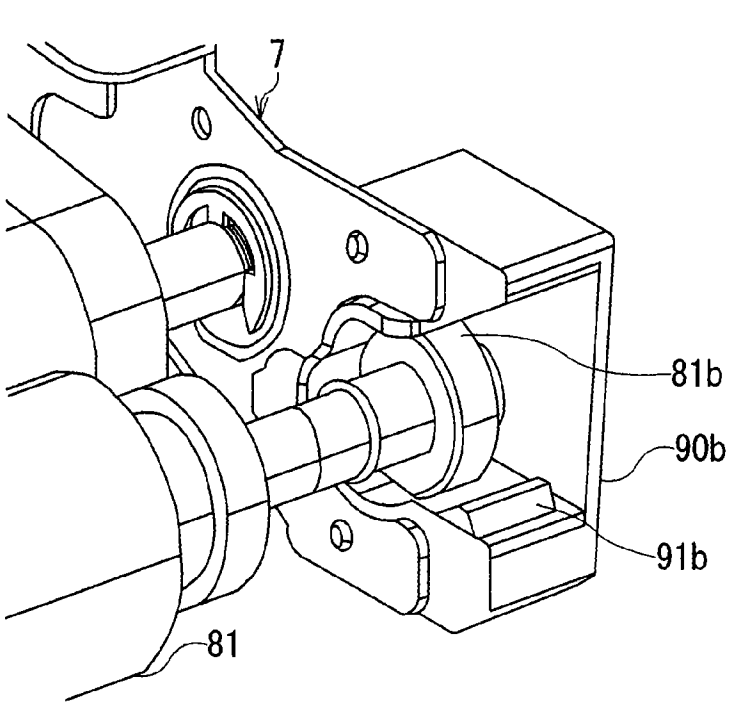
FIGS. 7A and 7B are enlarged perspective views each showing a state in which a bearing of a secondary transfer roller is received in a guide member of a primary transfer unit in a transfer apparatus of the embodiment.
Figure 7A:
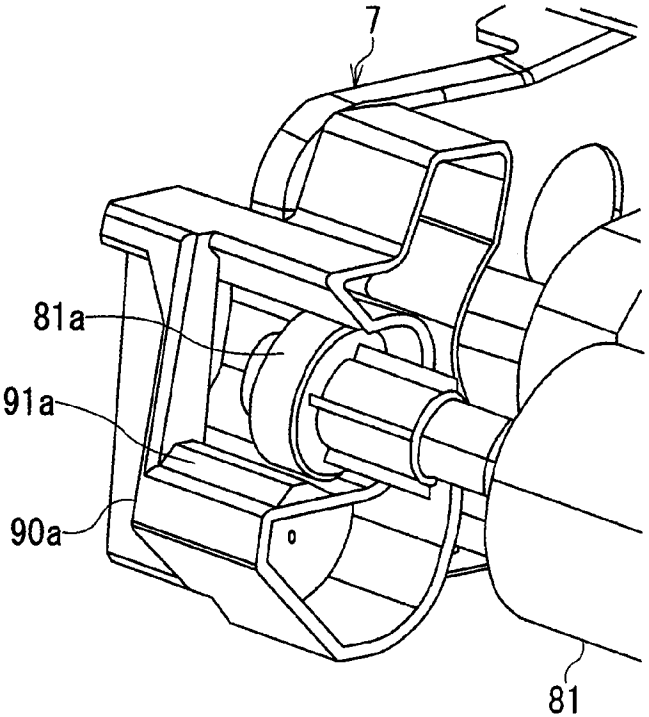
Figure 8:
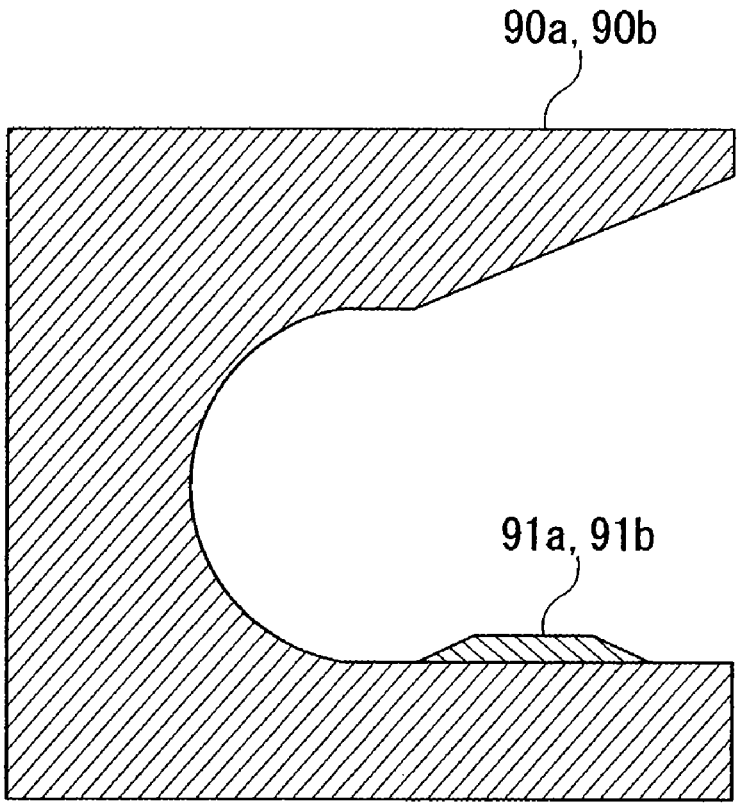
FIG. 8 is a sectional view schematically showing a guide member and a protrusion of the embodiment.

FIGS. 7A and 7B are enlarged views showing states in which the front side bearing 81*a* and the rear side bearing 81*b* are received in the front side guide member 90*a* and the rear side guide member 90*b* of the embodiment of the invention. FIG. 8 is an enlarged view schematically showing the section of each of the guide members 90*a* and 90*b*.

The outer periphery of the bearing 81*a*, 81*b* may be covered with a resin member or the like. Besides, the guide member 90*a*, 90*b* can also be formed of a resin member.

The protrusion 91*a*, 91*b* may be formed of a resin member integrally with the guide member 90*a*, 90*b*. The protrusion 91*a*, 91*b* may be formed of a resin member or the like as a separate body, and may be bonded to the bottom of the guide member 90*a*, 90*b*.

Figure 9C:
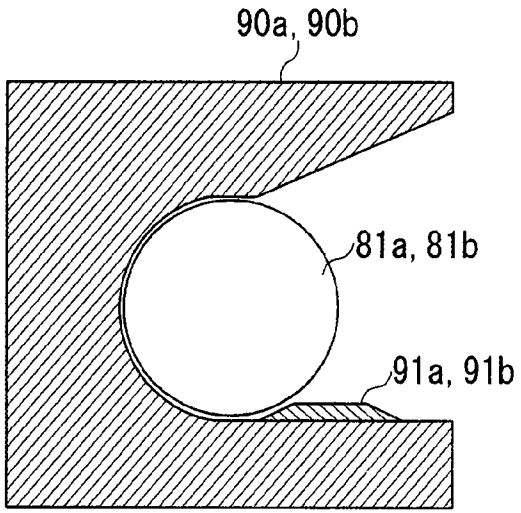
FIGS. 9A to 9C are explanatory views showing states in which the bearing of the secondary transfer roller is pushed into the guide member of the embodiment.
Figure 9B:
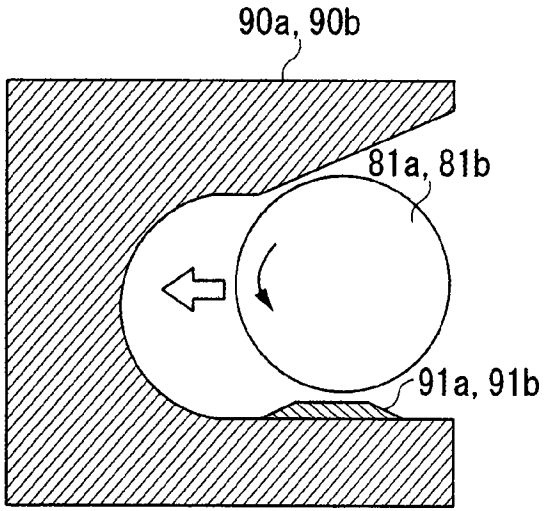
Figure 9A:
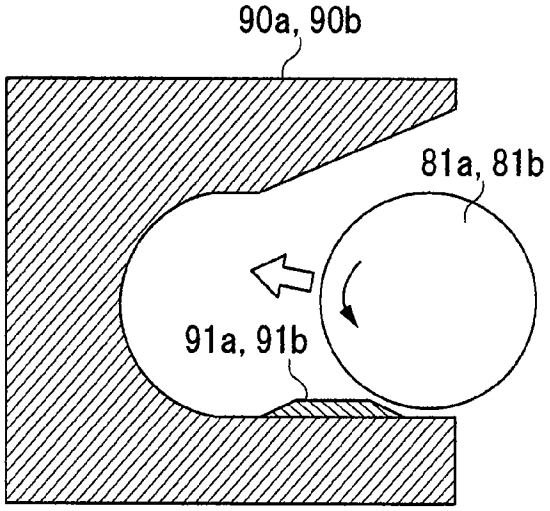

FIGS. 9A to 9C are views showing states arranged in time series, in which the secondary transfer unit 8 is being closed and the bearing 81*a*, 81*b* is being received in the guide member 90*a*, 90*b*.

The protrusion 91*a*, 91*b* is provided in the vicinity of an inlet of the guide member 90*a*, 90*b*, and as shown in FIGS. 9A to 9C, the bearing 81*a*, 81*b* climbs over the protrusion 91*a*, 91*b* while rotating, and is received in the inside of the guide member 90*a*, 90*b*.

A surface of the guide member opposite to the protrusion 91*a*, 91*b* is inclined to be widened outwardly so that the bearing 81*a*, 81*b* can easily pass through the inlet of the guide member even when the bearing 81*a*, 81*b* climbs over the top of the protrusion 91*a*, 91*b* (FIG. 9B).

The inner diameter of the guide member at the backward of the protrusion 91*a*, 91*b*, which receives the bearing 81*a*, 81*b*, is substantially equal to the outer diameter of the bearing 81*a*, 81*b*, and accurate alignment is possible.

Since the once received bearing 81*a*, 81*b* is hindered from moving toward the outside by the protrusion 91*a*, 91*b* (FIG. 9C), the secondary transfer unit 8 is fixed in the standing state. Thus, the dedicated opening and closing mechanisms (hook, spring, handle lever, magnet, etc.) required in the transfer apparatus of the related art become unnecessary, and the cost of parts is reduced. Besides, the assembling step and adjusting step of the opening and closing mechanisms in the manufacturing process become substantially zero, and the cost of the whole apparatus can be reduced.

Figure 10C:
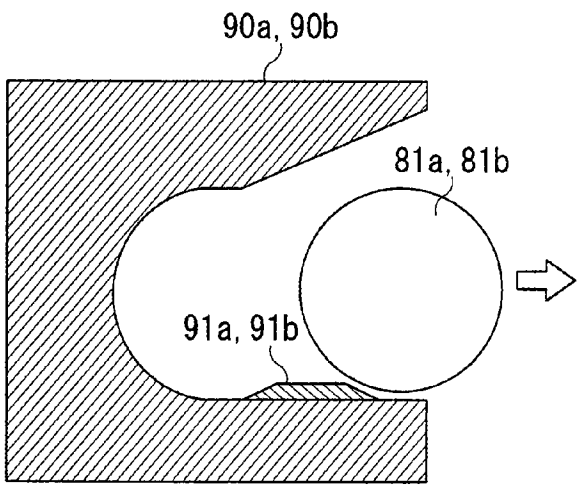
FIGS. 10A to 10C are explanatory views showing states in which the bearing of the secondary transfer roller is pulled out of the guide member of the embodiment.
Figure 10B:
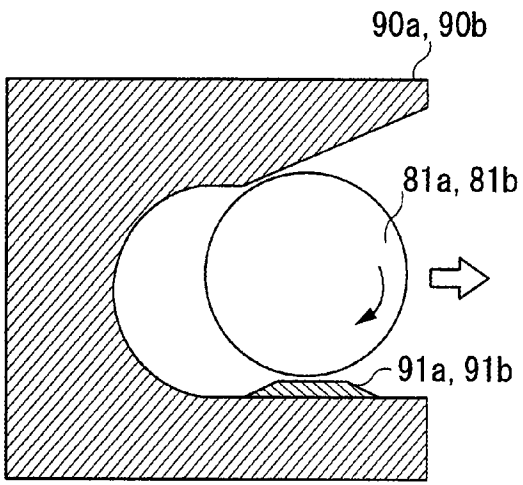
Figure 10A:
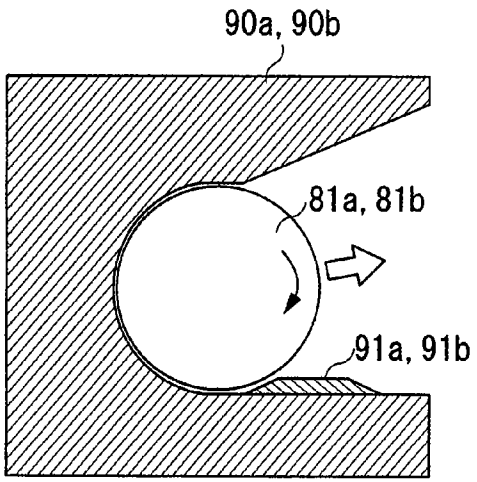

When a user opens the secondary transfer unit 8, the user applies a suitable outward force and pills it out. FIGS. 10A to 10C are views showing states arranged in time series, in which the secondary transfer unit 8 is opened, and the bearing 81*a*, 81*b* is pulled out of the inside of the guide member 90*a*, 90*b* to the outside. The bearing 81*a*, 81*b* climbs over the protrusion 91*a*, 91*b* while rotating by the pulling force applied by the user.

As described above, according to the transfer apparatus 9 of the embodiment and the image forming apparatus 1, the simple protrusion is provided on the guide member of the primary transfer unit, so that the opening and closing mechanism of the secondary transfer unit required in the related art is greatly simplified, and the dedicated opening and closing mechanism parts can be made substantially unnecessary, and as a result, the cost of the apparatus can be reduced.

The invention is not limited to the embodiments, but the components can be modified and embodied at the practical stage within the scope not departing from the gist. Besides, the invention of various embodiments can be formed by suitable combination of plural components disclosed in the embodiments. For example, some components may be deleted from all components disclosed in the embodiment. Further, components in different embodiments may be suitably combined.

What is claimed is:

1. A transfer apparatus comprising:

a primary transfer unit; and a secondary transfer unit that includes a transfer roller having a bearing and being capable of contacting with and separating from the primary transfer unit, wherein the primary transfer unit includes a guide member for receiving the bearing, and the guide member has a protrusion on a surface that the bearing contacts when the transfer roller contacts with and separates from the primary transfer unit.

2. The apparatus according to claim 1, wherein the protrusion is provided at an inlet of the guide member, and when the bearing is received inside of the guide member, and when the bearing is pulled out of the guide member, the bearing climbs over the protrusion while rotating.

3. The apparatus according to claim 2, wherein a surface of the guide member opposite to the protrusion is inclined to be widened outwardly, and the bearing can pass through the inlet of the guide member also when the bearing climbs over the protrusion.

4. The apparatus according to claim 2, wherein an inner diameter of the guide member adjacent the protrusion at which the bearing is received is substantially equal to an outer diameter of the bearing.

5. The apparatus according to claim 1, wherein the protrusion includes a separate member bonded to a bottom of the guide member.

6. The apparatus according to claim 5, wherein the guide member and the separate member are made of resin members.

7. The apparatus according to claim 1, wherein the protrusion is formed integrally with the guide member.

8. The apparatus according to claim 7, wherein the guide member is made of a resin member.

9. The apparatus according to claim 1, wherein an outer periphery of the bearing is covered with a resin member.

10. An image forming apparatus comprising:

a photoconductor on which a toner image is formed;

a primary transfer unit that includes a transfer belt and primarily transfers the toner image formed on the photoconductor to the transfer belt; and a secondary transfer unit that includes a transfer roller having a bearing and being capable of contacting with and separating from the primary transfer unit, and secondarily transfers the toner image primarily transferred on the transfer belt to a recording sheet, wherein the primary transfer unit includes a guide member for receiving the bearing, and the guide member has a protrusion on a surface that the bearing contacts when the transfer roller contacts with and separates from the primary transfer unit.

11. The apparatus according to claim 10, wherein the protrusion is provided at an inlet of the guide member, and when the bearing is received inside of the guide member, and when the bearing is pulled out of the guide member, the bearing climbs over the protrusion while rotating.

12. The apparatus according to claim 11, wherein a surface of the guide member opposite to the protrusion is inclined to be widened outwardly, and the bearing can pass through the inlet of the guide member also when the bearing climbs over the protrusion.

13. The apparatus according to claim 11, wherein an inner diameter of the guide member adjacent the protrusion at which the bearing is received is substantially equal to an outer diameter of the bearing.

14. The apparatus according to claim 10, wherein the protrusion includes a separate member bonded to a bottom of the guide member.

15. The apparatus according to claim 14, wherein the guide member and the separate member are made of resin members.

16. The apparatus according to claim 10, wherein the protrusion is formed integrally with the guide member.

17. The apparatus according to claim 16, wherein the guide member is made of a resin member.

18. The apparatus according to claim 10, wherein an outer periphery of the bearing is covered with a resin member.

* * * * *